US006163562A

United States Patent [19]

Franci

[11] Patent Number: 6,163,562

[45] Date of Patent: Dec. 19, 2000

[54] INDUCTION OVEN FOR MELTING METALS

[75] Inventor: François-Marie Franci, Pontault-Combault, France

[73] Assignee: Internova International Innovation Company B.V., Rotterdam, Netherlands

[21] Appl. No.: 09/423,732

[22] PCT Filed: May 15, 1998

[86] PCT No.: PCT/FR98/00971

§ 371 Date: Nov. 12, 1999

§ 102(e) Date: Nov. 12, 1999

[87] PCT Pub. No.: WO98/53642

PCT Pub. Date: Nov. 26, 1998

[30] Foreign Application Priority Data

May 16, 1997 [FR] France ..... 97 06279

[51] Int. Cl.[7] ..... H05B 6/22

[52] U.S. Cl. ..... 373/151; 373/156; 219/653

[58] Field of Search ..... 373/138, 146, 373/151, 152, 153, 59, 7; 219/653

[56] References Cited

U.S. PATENT DOCUMENTS 1,834,725 12/1931 Northrup .
1,879,360 9/1932 Linnhoff ..... 373/151
5,090,022 2/1992 Mortimer ..... 373/156

FOREIGN PATENT DOCUMENTS 351671 6/1928 Belgium .
266566 10/1913 Germany .
277870 9/1917 Germany .

*Primary Examiner*—Tu Ba Hoang
*Attorney, Agent, or Firm*—Davis and Bujold

[57] ABSTRACT

An induction heating device which raises the temperature of a metal to be heated for one of melting or hot machining while providing considerably energy saving, increasing yield and observing current safety standards. The device (10) uses a cavity (11) to receive the metal to be heated and at least two magnetic yokes (13) arranged around a periphery of cavity (11), each yoke supporting an independent induction coil (14). The induction coils are mounted and wound in the same direction such that a north pole, of each coil, is located on one side of the cavity and a south pole is located on an opposite side of the cavity. The inductive coils are arranged so as to generate active non null magnetic field zones and inactive zones of null magnetic fields distributed about the periphery of the cavity. An inactive zone of null magnetic fields is located between each adjacent active non null magnetic field zone. The induced current is self-enclosed thereby producing high heating power and the invention is applicable to melting, forging, reheating, transforming, and working metals by induction.

20 Claims, 5 Drawing Sheets

INDUCTION OVEN FOR MELTING METALS

FIELD OF THE INVENTION

The present invention relates to an induction heating device to raise the temperature of metals with a view to melting or hot working them, said device comprising at least one cavity defined by a ladle designed to receive the metals to be brought up to a temperature greater than or equal to their melting point or by an oven designed to receive the billets of metal to be brought up to a temperature which is lower than their melting point, this temperature being determined to forge the metals, along with induction heating means for said ladle or said oven.

BACKGROUND OF THE INVENTION

Induction heating devices are well known in the field of metal melting, forging billets of metal with a view to hot machining them, metal or alloy working or smelting. Nevertheless, in known devices, the induction coil(s) are wound around the cavity receiving the metal and are usually cooled by a water-cooling circuit. There is a possible risk of leaks in the cooling circuit, which is totally prohibited when working with molten metals. Furthermore, the efficiency achieved with this configuration generally does not exceed 40 to 60%. This efficiency is proportional to the ratio of the inductor's surface area and the surface area of the stack. What is more, the magnetic field created by the induction coils is an open field. Consequently, the losses are significant and amount to around ⅓ of the total power applied.

In this field of application, the main technical constraints to be taken into account are as follows:

- protecting people from electromagnetic fields, as laid down by French standards and European directives (CENELEC and DG5),
- efficiency, and
- safety (it is essential that any contact between the water and the molten metal be avoided).

Other induction heating devices have attempted to provide a solution to the first problem posed. Some devices are described in the publications DE-C-266 566, US-A-1 834 725 and BE-A-351 671 and comprise at least two yokes arranged around the cavity receiving the metal to be heated, which are L-shaped or C-shaped, so that the ends converge toward the inside of said cavity. Each yoke bears an electric coil creating a magnetic field which closes through said cavity. An improvement to this type of construction is described in the publication DE-C-277 870 which provides for three yokes, the coils of which are fed individually and phase-shifted in order to create a rotary field. In all these embodiments, all the magnetic fields are radial, which means that the lines of electric flux cross the cavity's axis and cross right through it axially. These magnetic fields create an induction current limited to the periphery of said cavity and generate an increase in the temperature of the metal in this zone with the remainder of the metal being heated by conduction. The efficiency of these various devices and even the one providing for a rotary field, remains very low, as the effective part of the field using for heating purposes is small.

SUMMARY OF THE INVENTION

The present invention proposes to overcome the drawbacks of the prior art and meet the requirements of current standards by means of an induction heating device which makes it possible to achieve efficiency in the region of 80 to 95%, with smaller induction boxes, a higher power factor (cos $\phi$0.8 instead of 0.05 or 0.1) and requiring less electric energy consumption. Furthermore, the present invention makes it possible to speed up the temperature rise and therefore the melting or hot machining of the metal, thus also favoring energy savings. The energy savings achieved by the present invention are such that a return on investment within about two years can be envisaged, which is very appreciable in commercial terms.

The aim is achieved by a device such as the one described in the preamble and characterized in that the induction coils are fitted in the same direction so that their north pole is located on one side of the cavity and their south pole on the opposite side, in that they are arranged so as to generate null magnetic field zones arranged alternately between non null field zones spread out on the periphery of the cavity, the non null field zones each comprising a maximum field zone associated with two decreasing field gradient zones arranged on either side of said maximum field zone, extending as far as the neighboring null field zones, as well as a null field zone located in the center of this cavity, the non null field zones forming active h eating zones separated by said null field zones forming inactive zones.

Each yoke offers the advantage of comprising an elongated branch extending from one end of the cavity to the other, which is arranged substantially parallel to the axis of this cavity and bears at least one induction coil designed to generate one of said active heating zones.

In a first form of embodiment of the invention, each yoke shows an L-shaped profile and comprises said elongated branch and a lateral branch extending substantially perpendicular to said elongated branch and substantially radially in relation to the end of the cavity.

Said cavity may be a ladle, said lateral branch extending radially in relation to the bottom of this ladle in the direction of its center.

In a second form of embodiment of the invention, each yoke shows a U-shaped profile and comprises said central elongated branch and two lateral branches extending substantially perpendicular to said central elongated branch and substantially radially in relation to the two ends of the cavity.

In this version, the cavity is preferably an oven and at least one of said lateral branches extends as far as the vicinity of the longitudinal wall delimiting said cavity.

In a third form of embodiment, each yoke shows a C-shaped profile and comprises said central elongated branch and two lateral branches extending substantially perpendicular to said central elongated branch and substantially radially in relation to the two ends of the cavity.

In this version, at least one of said lateral branches extends as far as the vicinity of the lateral wall delimiting said cavity.

Said cavity may be a ladle, with one of the lateral branches extending radially in relation to the bottom of this ladle and the other lateral branch being a free section directly attached to a cover designed to close said ladle and extending radially in relation to this cover as far as the vicinity of the lateral wall delimiting said cavity.

In a fourth form of embodiment, each yoke is I-shaped and comprises said elongated branch and two lateral branches extending substantially perpendicular to said elongated branch and substantially radially in relation to the two ends of the cavity.

In this version, at least one of said lateral branches extends radially as far as the vicinity of the lateral wall delimiting said cavity.

Each of said coils preferably extends substantially over the whole length of the yoke's elongated branch.

The heating means favorably comprise a number n of yokes spread out at regular intervals on the cavity's periphery.

Depending on the type of heating being sought the coils can be fed individually by an alternating electric current and this power supply can be phase-shifted from one coil to another. This power supply shift from one coil to another can be determined by an arithmetical progression.

BRIEF DESCRIPTION OF THE DRAWINGS

The various coils can also be fed by several generators designed to create a rotary field.

The present invention and its advantages shall be further disclosed in the following description of two examples of embodiment, with reference to the attached drawings, in which.

DESCRIPTION OF THE PREFERRED EMBODIMENTS

Figure 1:
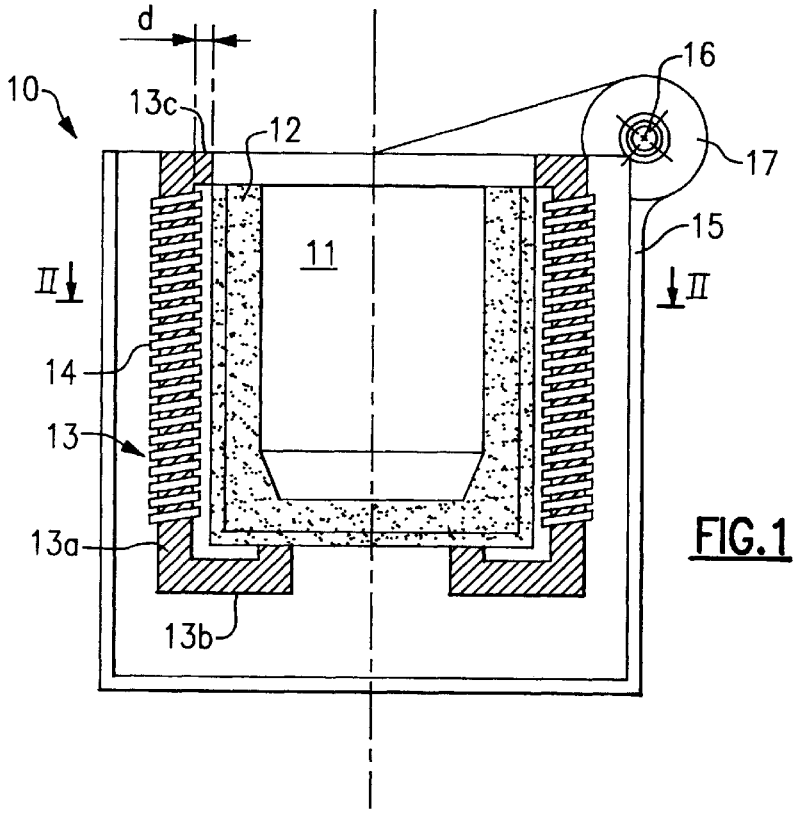
FIG. 1 is an axial cutaway view of a device according to the invention intended for metal melting purposes.
Figure 2:
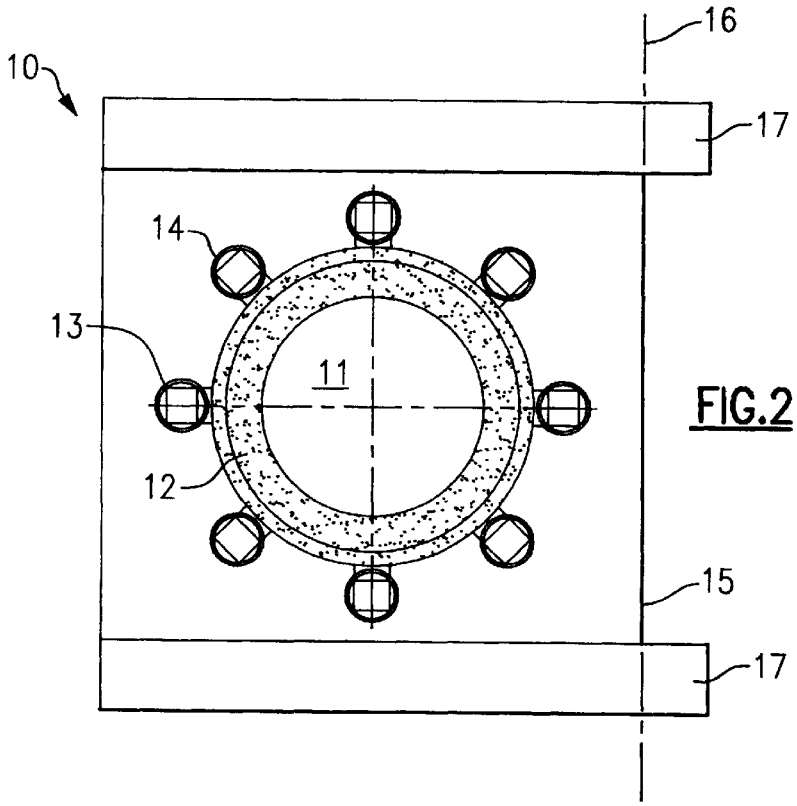
FIG. 2 is a cutaway topview along the II-II arrows of the oven in FIG. 1, FIGS. 3 and 4 are perspectives of the device in FIG. 1, topview and bottom view respectively.
Figure 3:
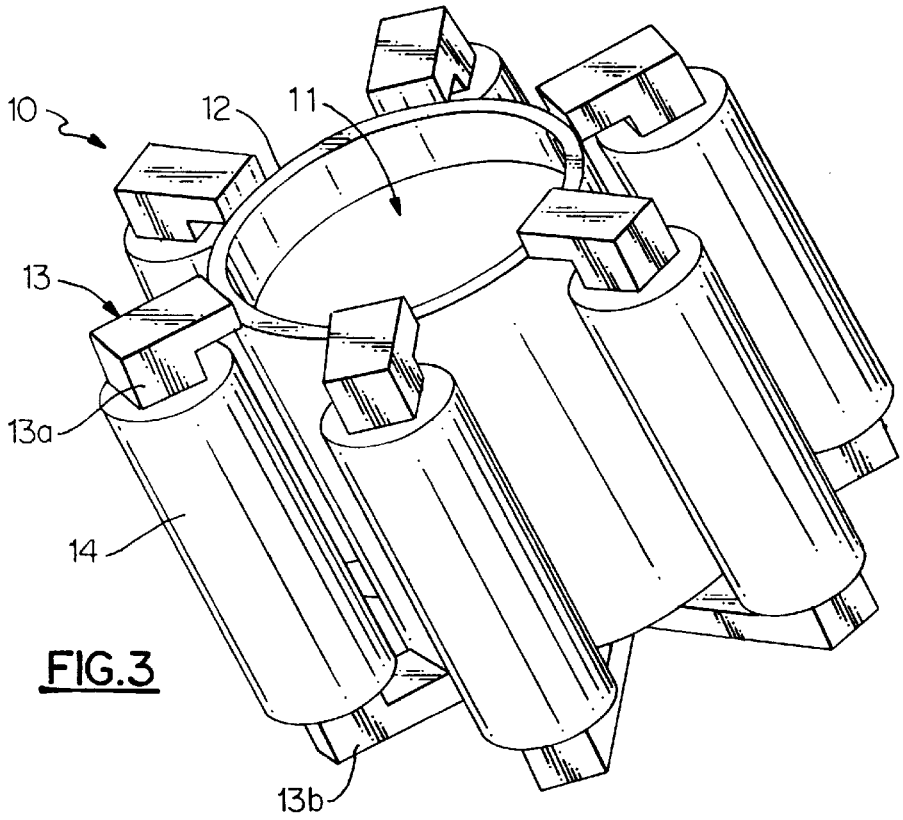
Figure 4:
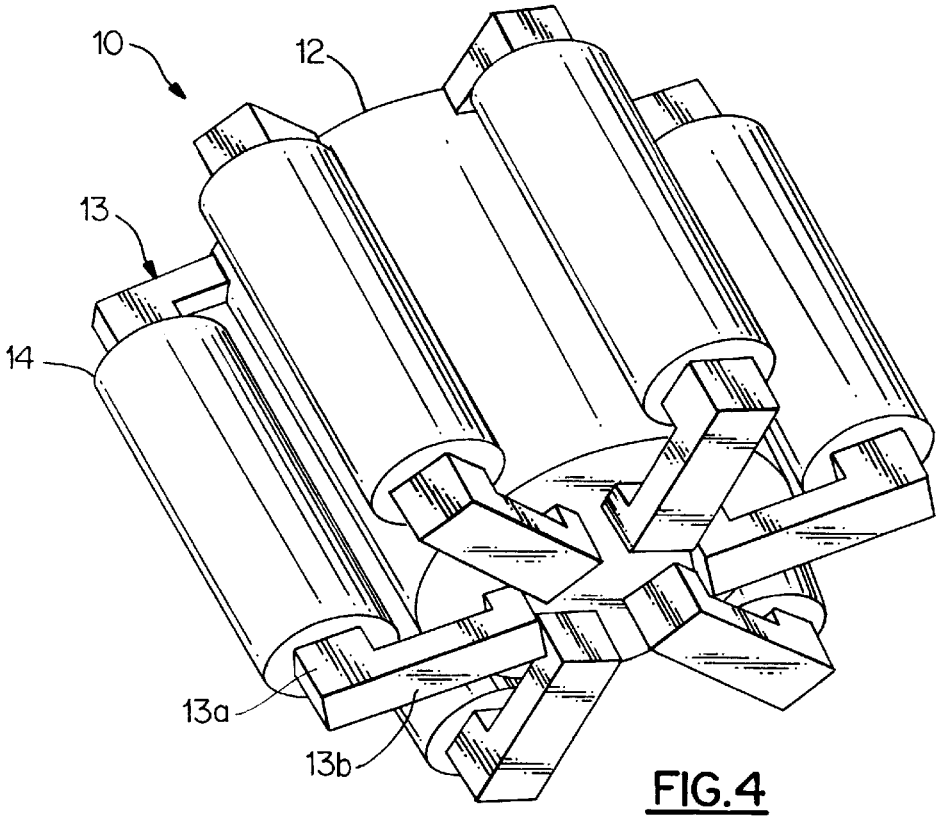

With reference to FIGS. 1 to 4, the induction heating device 10 comprises a cavity 11 formed by a ladle 12 generally made of a refractory material, which is designed to receive the metal to be melted, along with induction heating means designed to raise the temperature of the metal by means of a magnetic flux until it melts.

These heating means comprise independent magnetic yokes 13 arranged around the ladle 12 a sufficient distance d away to allow induction coils 14 to be put in place. Each yoke 13 is L-shaped overall and comprises an elongated branch 13*a* which is substantially parallel to the ladle's 12 axis and extends substantially over the whole height of said ladle 12 as well as a lateral branch 13*b* which is perpendicular to the elongated branch 13*a* and extends radially in the direction of the bottom of said ladle 12. The ends of the branches 13*a* and 13*b* are curved so that they are as close as possible to the ladle's 12 wall.

Depending on the case, the yokes 13 can be either C-shaped or I-shaped or even only have said elongated branch 13*a*. In any case, the elongated branch 13*a* of the magnetic yokes 13 extends substantially over the whole height of the ladle 12 and the lateral branch is oriented radially and preferably extends as far as the vicinity of the ladle's 12 wall. In some cases, the lateral branches can constitute a free section arranged perpendicular in relation to the elongated branch which folds for example in the vicinity of the bottom of the ladle if these branches are attached under a cover designed to close the ladle. In other cases, the lateral branches can extend as far as the middle of the bottom of the ladle. Finally, these lateral branches can be profiled so that they partly cover the surface area of the bottom of the ladle. In any case, the two lateral branches 13*b* of the same yoke must not both extend as far as the center of the ladle 12, at least one of them must stop in the vicinity of the edge of this ladle.

The number of these magnetic yokes 13 is n equal to eight (in FIGS. 1 and 2) and six (in FIGS. 3 and 4) and they are arranged normally at the same distance from one another around the ladle 12. This number n is not restrictive. It can also be lower or higher, even or odd, depending on the type of ladle and its specifications: capacity in tons of metal, heat power, etc.

The unit described above and formed by the ladle 12, the magnetic yokes 13 and the induction coils 14. is housed in a tank 15 designed for protection and insulation purposes which can be provided with a cover or a door (not shown), this tank being mounted tilting on a chassis or a bracket (not shown) around a joint pin 16 passing through two lugs 17 securely fixed to said tank 15. During the melting operation, this tank 15 can be hermetically sealed or not and can be placed under a vacuum to optimize the operation of the induction heating means. After the metal has been melted, the cover or the door opens, the tank 15 tilts around its joint 16 to empty the ladle 12 of its molten metal content into molds for example in the same manner as in the devices of the prior art.

Figure 6A:
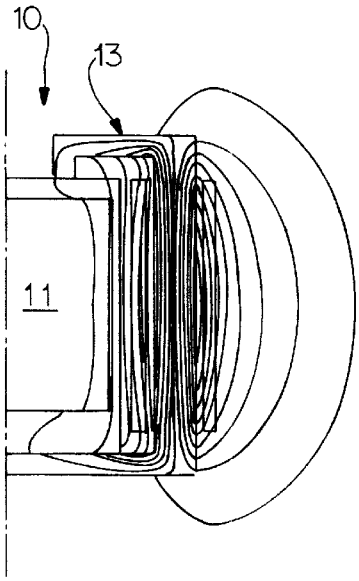
FIGS. 6A and 6B are diagrams representing the lines of the magnetic field of the device according to the invention and a standard device respectively.
Figure 6B:
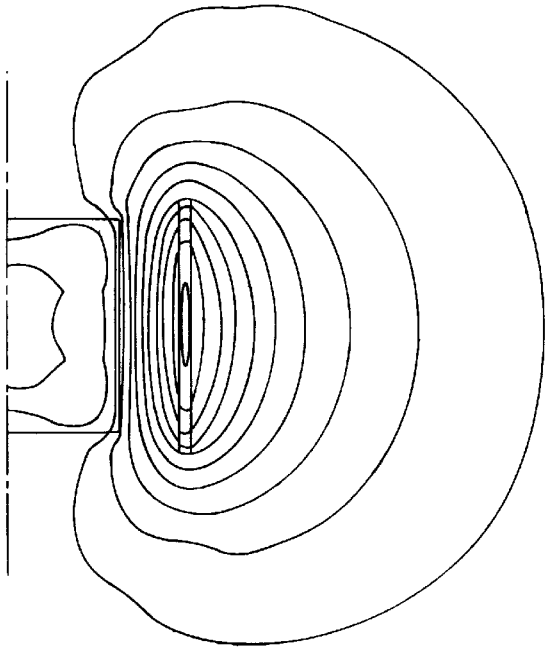

Each induction coil 14 is arranged around the elongated branch 13*a* of each magnetic yoke 13 and extends substantially over its whole length. These induction coils 14 are fed individually with an alternating current and generate a magnetic flux, whose lines of electric flux are shown in FIG. 6A. Due to the magnetic yokes 13, this magnetic flux is channeled, directed and closed in a peripheral zone inside the ladle 12 in the vicinity of said yoke, through the metal to be heated. Only a small part of the flux passes outside. Losses are therefore small. FIG. 6B shows the lines of electric flux for a device of the prior art which is not equipped with a magnetic yoke and highlights very clearly the improvement in the concentration of the lines of electric flux around the ladle 12 achieved using the device according to the invention with reference to FIG. 6A.

Figure 7A:
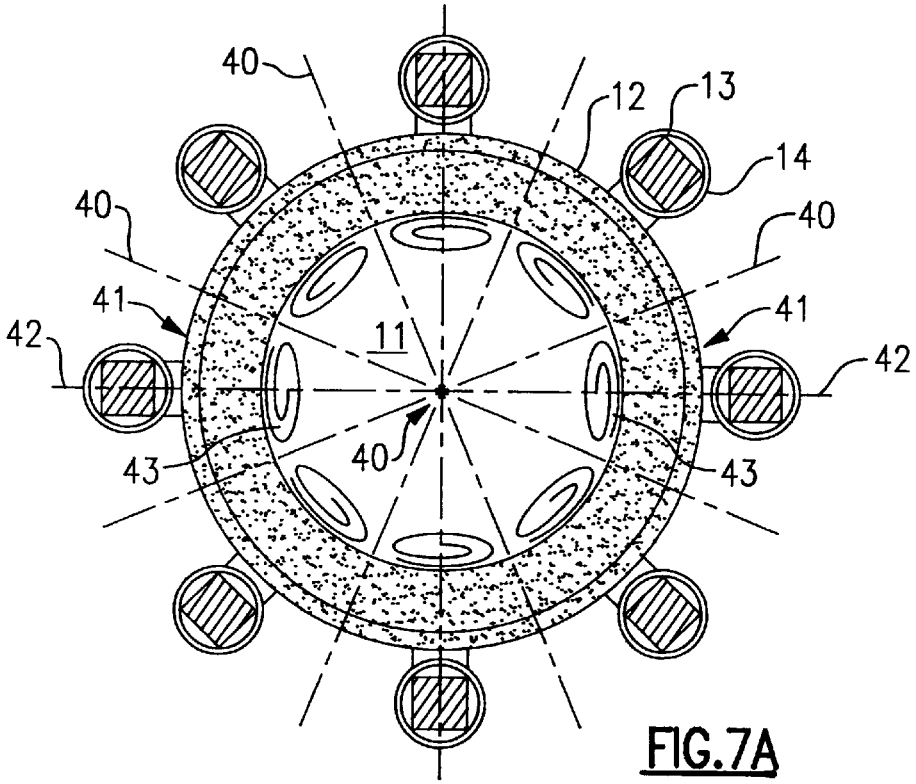
FIGS. 7A and 7B represent the cavity seen from above and schematically the flow of the induced currents for the device according to the invention and a standard device respectively.
Figure 7B:
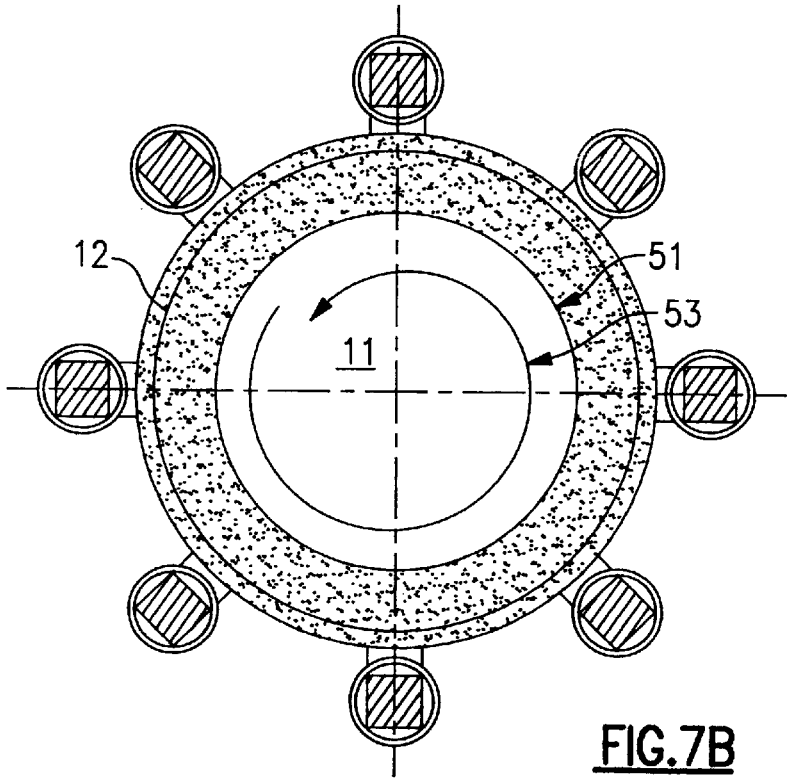

Furthermore, in the device according to the present invention, the coils 14 are all oriented in the same direction, their north pole being located on one side of the yokes and their south pole on the other side. The poles of the same kind thus repel each other by repelling their respective magnetic fields, thereby creating null magnetic field zones 40 alternating with non null magnetic field zones 41, shown schematically on FIG. 7A. Therefore, the non null field zones are centered on the radial planes 42 passing via the yokes' 13 axes and extend on either side of a maximum field zone, in the vicinity of the periphery of the cavity 11. These non null field zones 41 therefore comprise a maximum central field zone and two decreasing field gradient zones arranged on either side of the maximum field zone up to the neighboring null field zones 40. The lines of electric flux are arranged symmetrically on either side in relation to said radial planes 42 passing via the center of the cavity 11 and passing via the yokes' 13 axis. The null field zones 40 thus delimit active zones 41, made up of the maximum field zones and the decreasing field gradient zones, corresponding to the metal's heating zones. As a result, contrary to the device of the prior art, in which the heating zones 51 extend along the periphery of the ends of the cavity 11 as shown in FIG. 7B, the active heating zones 41 are delimited on defined angular portions of the periphery of said cavity 11. In other words, in each active zone 41, the magnetic field induces a current 43 generating a heat power, this current being obliged to close on itself forming a loop in this active zone, whereas in the devices of the prior art, the induced current 53 extends all around the periphery of the cavity. Furthermore, we do know that the induced current generates a heat power which is directly proportional to the volume of metal crossed by said current. Consequently, the fact that the currents 43 induced by the coils 14 are located in said active zones 41 makes it possible to significantly increase the volume of metal crossed by all the induced currents, in comparison with the volume of metal crossed by the current induced on the periphery. The result thus achieved is an increase in the volume of metal heated for the same induced current and therefore much greater efficiency.

Figure 8A:
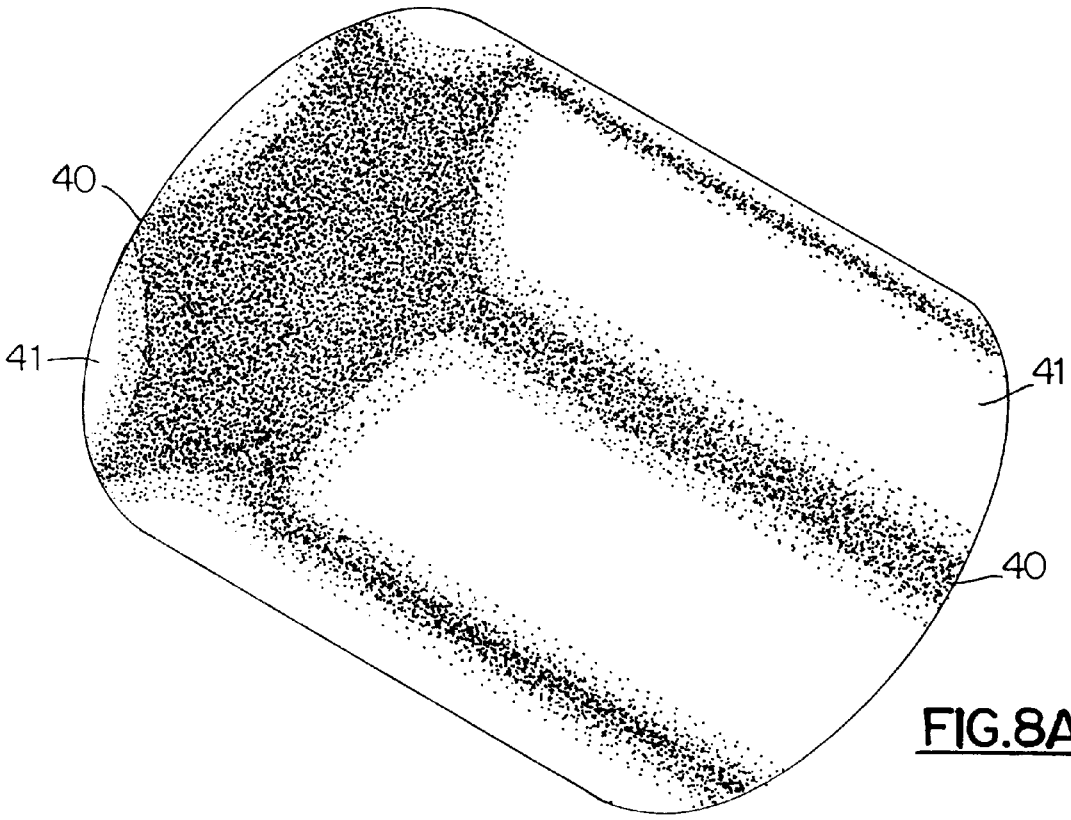
FIGS. 8A and 8B are diagrams representing the distribution of the heat power for the device according to the invention and a standard device respectively.
Figure 8B:
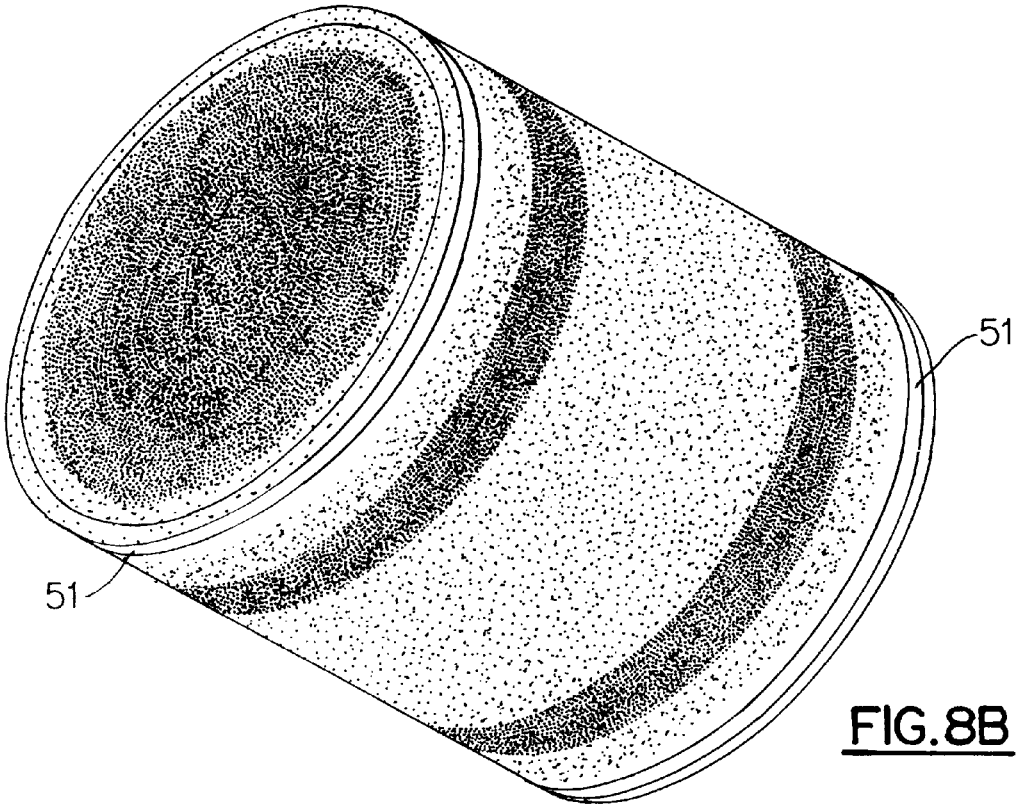

FIGS. 8A and 8B make it possible to compare the distribution of the heat power between the devices of the prior art and that of the invention, the white zones representing the highest heat power which falls gradually in the darker zones. There are of course various temperature levels which correspond to these various levels of heat power. These figures are illustrations of real tests carried out for the same induced current and therefore the same magnetic field generated by each coil. In FIG. 8B, which illustrates the prior art, the white zones correspond to the heating zones 51 and are limited to the periphery of the ends of the cavity with the inside being totally dark. In FIG. 8A, which illustrates the present invention, the white zones are spread around the circumference of the cavity and over its whole length. Several white zones can be observed, spread over the periphery of the cavity, extending over its whole length and being slightly prolonged toward the inside. These white zones correspond to the active heating zones 41 delimited from one another by said null field zones 40. It can then easily be seen that the entire surface covered by the white zones in FIG. 8A is much larger that the one in FIG. 8B. This increase in surface therefore has a direct effect on the efficiency of the induction heating which can reach 80 to 95%.

Furthermore, the distance d which separates the elongated branch 13*a* of the magnetic yoke 13 supporting the induction coil 14 from the ladle 12 may be relatively large to make it possible to increase the thickness of the refractory walls of the ladle 12 and limit heat losses. Furthermore, induction coils 14 with smaller diameters, lower outputs and greater power factors than those of the prior art can be used. As a result, the Joule's heat losses are also limited and the induction coils 14 do not need to be cooled by a specific water circulation. Air ventilation is sufficient to ensure cooling of said coils.

Under the effect of the active heating zones 41, the temperature of the metal rises quicker in certain zones, thus causing a shift or an automatic stirring between the hot masses of metal and the cooler ones so that in turn their temperature also rises to obtain a homogeneous molten mixture.

This stirring is considerably improved and accelerated by individually feeding the to induction coils 14 with a shift in the power supply from one coil to the next and so on, in a clockwise or anticlockwise direction. This phase shift in the power supply generates a circumferential and helicoidal stirring of the metal inside the ladle 12. The direct consequence of this form of stirring is a quicker homogenization of the temperature gradient in the metal, making it possible to considerably shorten the time required for it to soften and melt, thereby leading to significant energy savings. This forced stirring can also be achieved by feeding each coil via an independent generator. All the generators can then be synchronized so as to obtain a rotary field, thus creating the effect of a helix in the molten metal.

Figure 5:
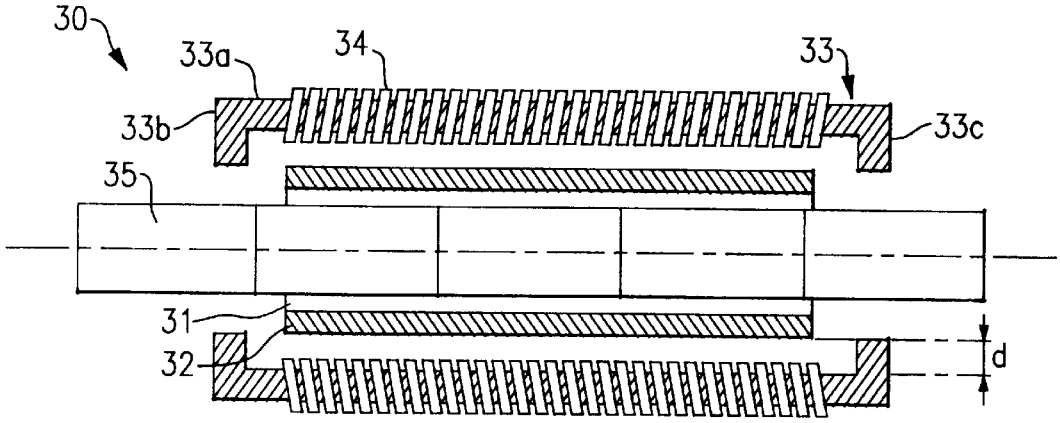
FIG. 5 is a longitudinal cutaway view of a device according to the invention intended for metal forging purposes.

FIG. 5 illustrates an alternative embodiment of the invention in which the device 30 comprises a cavity 31 formed by a oven 32 generally made of a refractory material and designed to receive billets of metal 35 to be hot machined, along with induction heating means 33, 34 designed to increase the temperature of said billets to a temperature lower than their melting point, by a magnetic flux. These heating means comprise, as in the previous example, independent magnetic yokes 33 arranged longitudinally around the oven 32 and a sufficient distance d to house induction coils 34 there. Each yoke 33 comprises an central elongated branch 33*a* and at least one lateral branch 33*b*, 33*c* perpendicular to the central elongated branch 33*a*. The central elongated branch 33*a* of the magnetic yokes 33 extends substantially over the whole length of the oven 32 and the two end branches 33*b* and 33*c* extend radially as far as the vicinity of the oven 32. In the example shown, the yokes 33 are generally U-shaped. Each induction coil 34 is arranged around the central elongated branch 33*a* of each magnetic yoke 33 and extends substantially over its whole length.

The number of magnetic yokes 33 and induction coils 34, they way they operate and their advantages are identical to the ones described previously. Likewise, it is also possible to optimize the homogenization of the temperature gradient inside and right along the oven 32 by feeding the induction coils 34 with a phase shift from one coil to the next or by independent synchronized generators.

It clearly emerges from this description that the invention reaches the intended aims. Its primary advantage is of course the energy savings which this induction heating device makes it possible to achieve while complying with current safety standards. Consequently, even if this device requires a greater overall investment compared with a known standard device, the energy gains achieved make it possible to envisage a return on investment within around two years.

The present invention is not limited to the examples of embodiment described but can be widened to include any modification and alternative which is obvious for the expert. As specified, the number of magnetic yokes and induction coils is not restricted. Likewise, the shape of the magnetic yokes may vary according to the ladle or the oven. The yokes may also be made up of several free sections. Managing the coils' power supply may also be deferred.

What is claimed is:

1. An induction heating device (10, 30), for heating a metal, comprising:

a ladle (12) defining at least one cavity (11) for receiving and heating a metal, via induction heating devices (13, 14), to a temperature at least equal to a melting temperature of the metal, the induction heating devices (13, 14) comprising at least two magnetic yokes (13) arranged around a periphery of the cavity (11) and having a longitudinal length which is greater than a height of the cavity (11);

each yoke having at least one independent induction coil (14), and each induction coil (14) is wound in the same direction so that a north pole, of each one of the induction coils (14), is located at one of a top and bottom end of the cavity (11) and a south pole, of each one of the induction coils (14), is located an opposite end of the cavity (11), each one of the induction heating devices (13, 14) generating, about the periphery of the cavity, a non null field zone (41) and a null magnetic field zone (40) being created between each adjacent pair of non null field zones (41);

each non null field zone comprising a centrally located maximum field zone and a decreasing field gradient zone arranged on either side of the central maximum field zone with each decreasing field gradient separating the central maximum field zone from one of the null field zones (40); and a central null field zone (40) located in the center of the cavity, and each one of the non null field zones forming an active heating zone and each one of the null field zones forming an inactive heating zone.

2. The induction heating device according to claim 1, wherein each of the at least two yokes (13) further comprise an elongate branch (13*a*) which extends from adjacent a top end of the cavity to adjacent an opposed bottom end of the cavity, and the elongate branch extends substantially parallel to a longitudinal axis of the cavity (11) and supports a t least one induction coil (14) for generating one of the active heating zones (41).

3. The induction heating device according to claim 1, wherein each of the at least two yokes (13) has an L-shaped profile and comprises an elongate branch (13*a*), which extends substantially parallel to a longitudinal axis of the cavity (11), and a lateral branch (13*b*) which extends substantially perpendicular to the elongate branch (13*a*) and substantially radially inward in relation to the longitudinal axis of the cavity (11).

4. The induction heating device according to claim 3, wherein the lateral branch (13*b*) extends radially toward the longitudinal axis of the ladle adjacent a bottom surface of the ladle.

5. The induction heating device according to claim 1, wherein each yoke has a C-shaped profile and comprises an elongate branch (13*a*), which extends substantially parallel to a longitudinal axis of the cavity (11), and two lateral branches (13*b*, 13*c*), a first one of the two lateral branches (13*b*) extends from a first end of the elongate branch (13*a*) substantially perpendicular thereto and substantially radially in relation to the longitudinal axis of the cavity (11) and a second one o f the two lateral branches (13*c*) extends from a second opposed end of the central elongate branch (13*a*) substantially perpendicular thereto and substantially radially in relation to the longitudinal axis of the cavity (11).

6. The induction heating device according to claim 5, wherein at least one of the lateral branches extends adjacent a vicinity of a lateral wall delimiting the cavity (11).

7. The induction heating device according to claim 6, wherein one of the lateral branches of the yoke extends radially in relation to the longitudinal axis along a bottom surface of the ladle and the other lateral branch of the yoke being a free section directly attached to a cover for closing the ladle and the other lateral branch extends radially relative to cover adjacent the vicinity of the lateral wall delimiting the cavity (11).

8. The induction heating device according to claim 1, wherein each yoke is I-shaped and comprises an elongate branch (13*a*), which extends substantially parallel to a longitudinal axis of the cavity (11), and two lateral branches (13*b*, 13*c*), a first one of the two lateral branches (13*b*) extends from a first end of the central elongate branch (13*a*) substantially perpendicular thereto along a top surface of the cavity (11) and a second one of the two lateral branches (13*c*) extends from a second opposed end of the central elongate branch (13*a*) substantially perpendicular thereto and along a bottom surface of the cavity (11).

9. The induction heating device according to claim 8, wherein at least the first one of the lateral branches extends radially as far as a lateral wall delimiting the cavity.

10. The induction heating device according to claim 2, wherein the induction coil (14) extends substantially along an entire length of the elongate branch (13*a*) of the respective yoke (13).

11. The induction heating device according to claim 1, wherein the induction heating devices (13, 14), which comprise at least two magnetic yokes (13) each having at least one independent induction coil (14), are equally spaced at regular intervals about a periphery of the cavity (11).

12. The induction heating device according to claim 11, wherein the induction coils (14) are each fed individually by an alternating electric current which is phase-shifted from one induction coil (14) to another induction coil (14).

13. The induction heating device according to claim 12, wherein the alternating electric current which is phase-shifted from one induction coil (14) to another induction coil (14) is determined by an arithmetical progression.

14. The induction heating device according to claim 13, wherein the induction coils (14) are supplied with electrical supplied by several generators.

15. An induction heating device (10, 30), for heating a metal, comprising:

an oven (32) defining at least one cavity (31) for receiving and heating billets of a metal to be heated, via induction heating devices (33, 34), to a temperature lower than a melting point of the metal but sufficient to facilitate forging of the metal, the induction heating devices (33, 34) comprising at least two magnetic yokes (33) arranged around a periphery of the cavity (31) and having a longitudinal length which is greater than a height of the cavit each yoke having at least one independent induction coil (34), and each induction coil (34) is wound in the same direction so that a north pole, of each one of the induction coils (34), is located at one end of the cavity (31 ) and a south pole, of each one of the induction coils (34), is located an opposite end of the cavity (31), each one of the induction heating devices (33, 34) generating, about the periphery of the cavity, a non null field zone (41) and a null magnetic field zone (40) being created between each adjacent pair of non null field zones (41);

each non null field zone comprising a centrally located maximum field zone and a decreasing field gradient zone arranged on either side of the central maximum field zone with each decreasing field gradient separating the central maximum field zone from one of the null field zones (40); and a central null field zone (40) located in the center of the cavity, and each one of the non null field zones forming an active heating zone and each one of the null field zones forming an inactive heating zone.

16. The induction heating device according to claim 15, wherein each of the at least two yokes (33) has a U-shaped profile and comprises a central elongate branch (33*a*), which extends substantially parallel to a longitudinal axis of the cavity (31), and two lateral branches (33*b*, 33*c*), a first one of the two lateral branches (33*b*) extends from a first end of the central elongate branch (33*a*) substantially perpendicular thereto and a second one of the two lateral branches (33*c*) extends from a second opposed end of the central elongate branch (33*a*) substantially perpendicular thereto.

17. The induction heating device according to claim 15, wherein each yoke has a C-shaped profile and comprises an elongate branch (33*a*), which extends substantially parallel to a longitudinal axis of the cavity (31), and two lateral branches (33*b*, 33*c*), a first one of the two lateral branches (33*b*) extends from a first end of the elongate branch (33*a*) substantially perpendicular thereto and substantially radially in relation to the longitudinal axis of the cavity (31) and a second one of the two lateral branches (33*c*) extends from a second opposed end of the central elongate branch (33*a*) substantially perpendicular thereto and substantially radially in relation to the longitudinal axis of the cavity (31).

18. The induction heating device according to claim 16, wherein each yoke is I-shaped and comprises an elongate branch (33*a*), which extends substantially parallel to a longitudinal axis of the cavity (31), and two lateral branches (33*b*, 33*c*), a first one of the two lateral branches (33*b*) extends from a first end of the central elongate branch (33*a*) substantially perpendicular thereto along a top surface of the cavity (31) and a second one of the two lateral branches (33*c*) extends from a second opposed end of the central elongate branch (33*a*) substantially perpendicular thereto and along a bottom surface of the cavity (31).

19. The induction heating device according to claim 18, wherein at least the first one of the lateral branches extends as far as a vicinity of a lateral wall delimiting the cavity.

20. An induction heating device for heating a metal, comprising:

a heating member defining at least one cavity for receiving and heating a metal to be heated, via induction heating devices to a temperature at least sufficient to facilitate forging of the metal, the induction heating devices comprising at least two magnetic yokes arranged around a periphery of the cavity and having a longitudinal length which is greater than a height of the cavity;

each yoke having at least one independent induction coil, and each induction coil is wound in the same direction so that a north pole, of each one of the induction coils, is located at one end of the cavity and a south pole, of each one of the induction coils, is located an opposite end of the cavity, each one of the induction heating devices generating, about the periphery of the cavity, a non null field zone and a null magnetic field zone being created between each adjacent pair of non null field zones;

each non null field zone comprising a centrally located maximum field zone and a decreasing field gradient zone arranged on either side of the central maximum field zone with each decreasing field gradient separating the central maximum field zone from one of the null field zones; and a central null field zone located in the center of the cavity, and each one of the non null field zones forming an active heating zone and each one of the null field zones forming an inactive heating zone.

* * * * *